US010247372B2

(12) United States Patent
Wilcox et al.

(10) Patent No.: US 10,247,372 B2
(45) Date of Patent: Apr. 2, 2019

(54) LED TROFFER LENS ASSEMBLY MOUNT

(71) Applicant: Cree, Inc., Durham, NC (US)

(72) Inventors: Kurt Wilcox, Libertyville, IL (US); Donald Walker, Union Grove, WI (US); Curt Progl, Raleigh, NC (US); Randall Levy Bernard, Cary, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 15/425,371

(22) Filed: Feb. 6, 2017

(65) Prior Publication Data

US 2018/0224075 A1 Aug. 9, 2018

(51) Int. Cl.

| | |
|---|---|
| ***F21K 9/27*** | (2016.01) |
| ***F21K 9/272*** | (2016.01) |
| ***F21K 9/20*** | (2016.01) |
| ***F21S 8/02*** | (2006.01) |
| ***F21V 5/04*** | (2006.01) |
| ***F21V 7/22*** | (2018.01) |
| ***F21V 17/10*** | (2006.01) |
| ***F21V 23/00*** | (2015.01) |
| ***F21V 23/04*** | (2006.01) |
| ***F21V 31/00*** | (2006.01) |
| ***F21V 15/015*** | (2006.01) |
| ***F21Y 115/10*** | (2016.01) |

(52) U.S. Cl.

CPC ..... *F21S 8/026* (2013.01); *F21K 9/272* (2016.08); *F21V 5/04* (2013.01); *F21V 15/015* (2013.01); *F21K 9/20* (2016.08); *F21K 9/27* (2016.08); *F21V 7/22* (2013.01); *F21V 17/10* (2013.01); *F21V 23/008* (2013.01); *F21V 23/045* (2013.01); *F21V 31/005* (2013.01); *F21Y 2115/10* (2016.08)

(58) Field of Classification Search

CPC .. F21S 8/026; F21K 9/27; F21K 9/272; F21K 9/66

See application file for complete search history.

(56) References Cited

U.S. PATENT DOCUMENTS 3,350,557 A 10/1967 Szymanski
3,355,583 A 11/1967 Sellenraad et al.
(Continued)

OTHER PUBLICATIONS

U.S. Appl. No. 15/226,992, filed Aug. 3, 2016.
(Continued)

*Primary Examiner* — Alexander K Garlen
(74) *Attorney, Agent, or Firm* — Myers Bigel, PA

(57) ABSTRACT

A light fixture includes a LED assembly and a housing. A lens assembly comprises a lens and a first end cap and a second end cap. The end caps are releasably connected to the housing such that the lens and the end caps are releasably mounted to the housing as a unit. The end caps may be releasably mounted to the housing by a deformable, resilient first engagement member that releasably engages a second engagement when the lens assembly is moved relative to the housing in a first direction. A force is created between the first engagement member and the second engagement member sufficient to hold the lens assembly in the housing and low enough that the lens assembly is removable from the housing by pulling the lens assembly in a second direction opposite to the first direction.

19 Claims, 16 Drawing Sheets

(56) References Cited

U.S. PATENT DOCUMENTS

| | | | | |
|---|---|---|---|---|
| 7,481,552 | B2 * | 1/2009 | Mayfield, III | F21S 8/04 362/223 |
| 7,510,305 | B2 * | 3/2009 | Straton | F21S 8/04 362/223 |
| 8,736,186 | B2 | 5/2014 | Chobot | |
| 8,829,821 | B2 | 9/2014 | Chobot et al. | |
| 8,912,735 | B2 | 12/2014 | Chobot et al. | |
| 8,975,827 | B2 | 3/2015 | Chobot et al. | |
| 9,155,165 | B2 | 10/2015 | Chobot | |
| 9,155,166 | B2 | 10/2015 | Chobot | |
| 9,433,061 | B2 | 8/2016 | Chobot | |
| 9,572,226 | B2 | 2/2017 | Motley et al. | |
| 2007/0183148 | A1 * | 8/2007 | Mayfield, III | F21V 5/02 362/223 |
| 2007/0247414 | A1 | 10/2007 | Roberts | |
| 2008/0298056 | A1 | 12/2008 | Petersen | |
| 2010/0091484 | A1 * | 4/2010 | Mayfield, III | F21S 8/026 362/223 |
| 2010/0128485 | A1 * | 5/2010 | Teng | F21V 5/00 362/294 |
| 2012/0169234 | A1 * | 7/2012 | Shew | H02J 9/065 315/88 |
| 2012/0195032 | A1 * | 8/2012 | Shew | H02J 9/065 362/183 |
| 2013/0051008 | A1 * | 2/2013 | Shew | H02J 9/065 362/235 |
| 2014/0160742 | A1 * | 6/2014 | Rodgers | F21V 23/02 362/222 |
| 2014/0225513 | A1 * | 8/2014 | Park | H05B 33/0848 315/151 |
| 2014/0268748 | A1 * | 9/2014 | Lay | F21V 15/01 362/235 |
| 2014/0268790 | A1 | 9/2014 | Chobot et al. | |
| 2014/0355272 | A1 * | 12/2014 | Chou | F21S 4/008 362/308 |
| 2015/0022114 | A1 * | 1/2015 | Kim | H05B 33/0803 315/294 |
| 2015/0062913 | A1 | 3/2015 | Howe | |
| 2015/0102729 | A1 | 4/2015 | Creasman et al. | |
| 2015/0159839 | A1 | 6/2015 | Howe | |
| 2016/0116118 | A1 * | 4/2016 | Bernard | F21S 8/026 362/224 |
| 2017/0205036 | A1 | 7/2017 | Sorensen et al. | |

OTHER PUBLICATIONS

U.S. Appl. No. 61/932,058, filed Jan. 27, 2014.
U.S. Appl. No. 62/292,528, filed Feb. 8, 2016.
U.S. Appl. No. 15/469,868, Office Action, dated May 29, 2018.

* cited by examiner

LED TROFFER LENS ASSEMBLY MOUNT

BACKGROUND OF THE INVENTION

The invention relates to lighting fixtures and, more particularly, to indirect, direct, and direct/indirect lighting troffers that are well-suited for use with solid state lighting sources, such as light emitting diodes (LEDs).

Troffer-style fixtures are ubiquitous in residential, commercial, office and industrial spaces throughout the world. In many instances these troffer-style fixtures include troffers that house elongated fluorescent light bulbs that span the length of the troffer. Troffers may be mounted to or suspended from ceilings. Often the troffer may be recessed into the ceiling, with the back side of the troffer protruding into the plenum area above the ceiling. Elements of the troffer on the back side may dissipate heat generated by the light source into the plenum where air can be circulated to facilitate the cooling mechanism.

More recently, with the advent of efficient solid state lighting sources, these troffers have been used with LEDs. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. LEDs can emit the same luminous flux as incandescent and fluorescent lights using a fraction of the energy. In addition, LEDs can have a significantly longer operational lifetime.

SUMMARY OF THE INVENTION

In some embodiments a troffer light fixture comprises a LED assembly comprising at least one LED operable to emit light when energized through an electrical path and a housing. A lens assembly comprises a lens covering the at least one LED and a first end cap and a second end cap. The lens has a first end connected to the first end cap and a second end connected to the second end cap. The first end cap and the second end cap are releasably connected to the housing such that the lens and the first end cap and the second end cap are releasably mounted to the housing as a unit.

The LED assembly may comprise a LED board supporting a plurality of LEDs where the LED board is in the electrical path. The lens may be resiliently deformable. The lens may be made of diffusive plastic. The lens may comprise a first longitudinal edge and a second longitudinal edge where the first and second longitudinal edges of the lens may be compressed toward one another upon the application of a force. The housing may comprise a first slot for receiving the first longitudinal edge and a second slot for receiving the second longitudinal edge where the first longitudinal edge is biased against the first slot and the second longitudinal edge is biased against the second slot. The first end cap may comprise a first slot for receiving the first end and the second end cap may comprise a second slot for receiving the second end. A first retaining member may retain the first end in the first slot and a second retaining member may retain the second end in the second slot. The first and second retaining members may comprise resilient members that are deformed into engagement with the lens to create a force on the lens sufficient to retain the first end cap and the second end cap on the lens. The first end cap and the second end cap may be releasably mounted to the housing by a deformable, resilient first engagement member on one of the housing and the first end cap and second cap that releasably engages a second engagement on the other one of the housing and the first end cap and the second end cap. The second engagement member may comprise a rigid member. The second engagement member may comprise a receptacle for receiving the first engagement member. The first engagement member may engage the second engagement member by moving the lens assembly in a first insertion direction relative to the housing. The first engagement member may be disengaged from the second engagement member by moving the lens assembly in a second direction opposite to the first insertion direction. The first insertion direction and the second direction may be substantially linear. A force may be created between the first engagement member and the second engagement member where the force is sufficient to hold the lens assembly in the housing and low enough that the lens assembly is removable from the housing by pulling the lens assembly in the second direction.

In some embodiments a light fixture comprises a LED assembly comprising at least one LED operable to emit light when energized through an electrical path and a housing. A communication component housing is snap-fit to the housing and contains at least one communication component. A lens assembly may comprise a lens covering the at least one LED and a first end cap and a second end cap where the first end cap and the second end cap may be releasably mounted to the housing by a deformable, resilient first engagement member on one of the housing and the first end cap and second cap that releasably engages a second engagement on the other one of the housing and the first end cap and the second end cap.

At least one of the first end cap and the second end cap may comprise an aperture in communication with the communication component housing. A force may be created between the first engagement member and the second engagement member that is sufficient to hold the lens assembly in the housing and low enough that the lens assembly is removable from the housing by pulling the lens assembly in a second direction opposite to the first insertion direction. The lens may comprise a first longitudinal edge and a second longitudinal edge where the first and second longitudinal edges of the lens are compressed toward one another and the housing may comprise a first slot for receiving the first longitudinal edge and a second slot for receiving the second longitudinal edge where the first longitudinal edge is biased against the first slot and the second longitudinal edge is biased against the second slot.

In some embodiments a troffer light fixture comprises a LED assembly comprising at least one LED operable to emit light when energized through an electrical path and a housing defining a first longitudinal slot and a second longitudinal slot. A lens assembly comprises a lens covering the at least one LED and a first end cap and a second end cap. The lens comprises a first longitudinal edge and a second longitudinal edge where the first and second longitudinal edges of the lens are compressed toward one another such that the first slot receives the first longitudinal edge and the second slot receives the second longitudinal edge where the first longitudinal edge is biased against the first slot and the second longitudinal edge is biased against the second slot. The first end cap and the second end cap may be releasably connected to the housing such that the lens and the first end cap and the second end cap are releasably mounted to the housing as a unit.

DETAILED DESCRIPTION OF EMBODIMENTS OF THE INVENTION

Figure 1A:
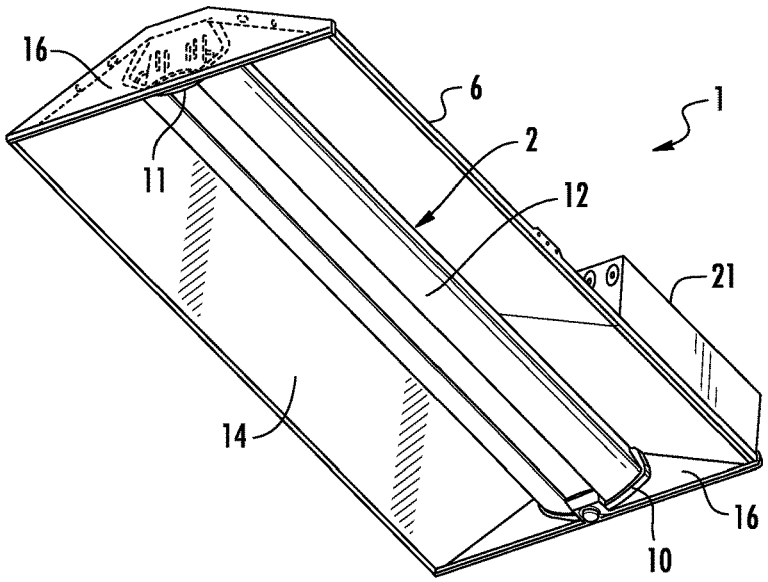
FIG. 1A is a perspective view of an embodiment of a lighting fixture.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Figure 1B:
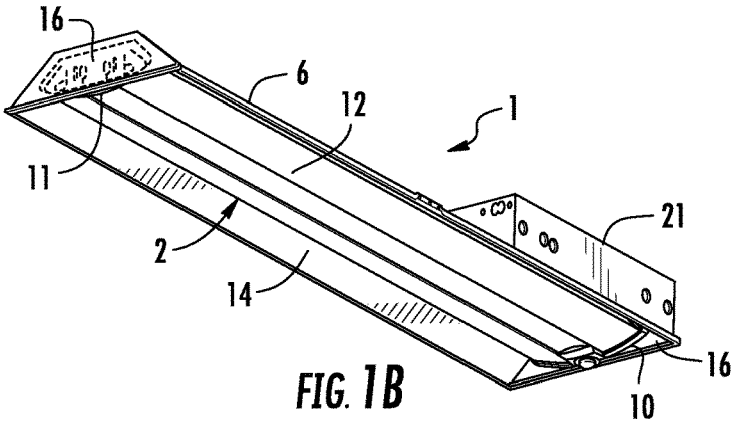
FIG. 1B is a perspective view of an embodiment of a lighting fixture similar to the lighting fixture of FIG. 1 having different dimensions.
Figure 1C:
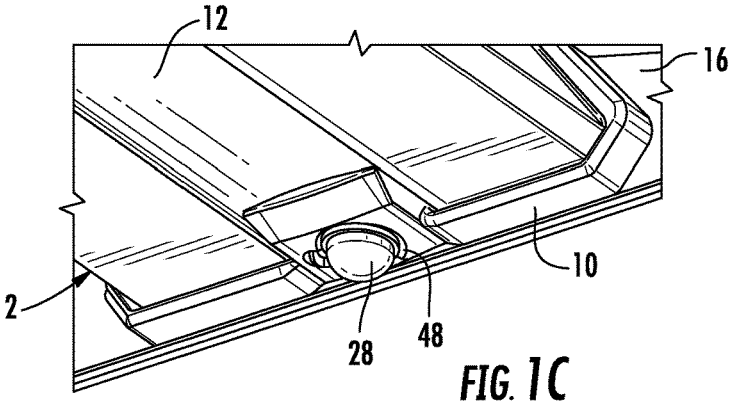
FIG. 1C is a detailed perspective view of the lighting fixture of FIG. 1.
Figure 8:
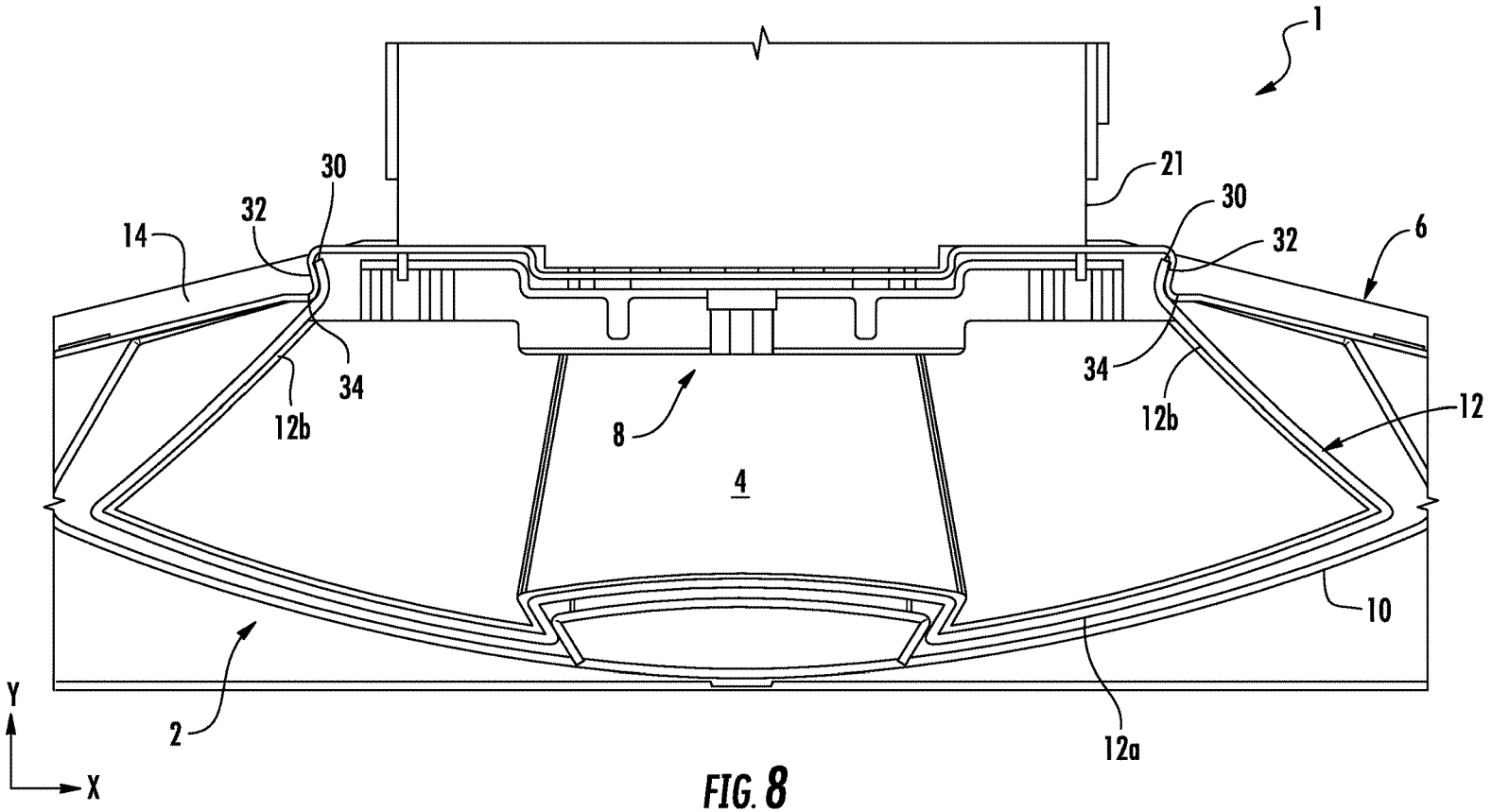
FIG. 8 is a partial section view showing a lens assembly mounted in a troffer housing.
Figure 9:
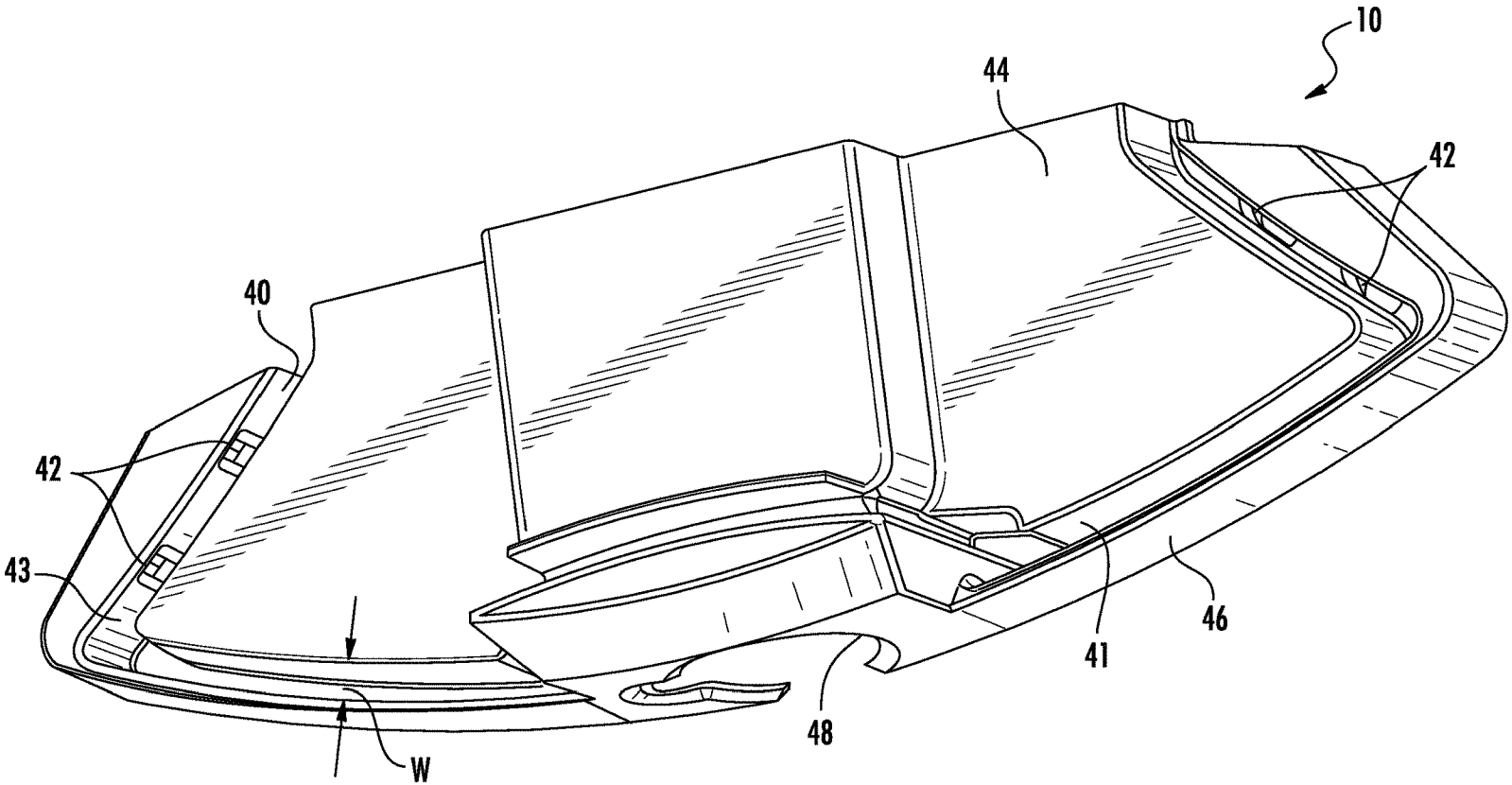
FIGS. 9 and 10 are perspective front views showing alternate embodiments of an end cap usable in the lens assembly.
Figure 10:
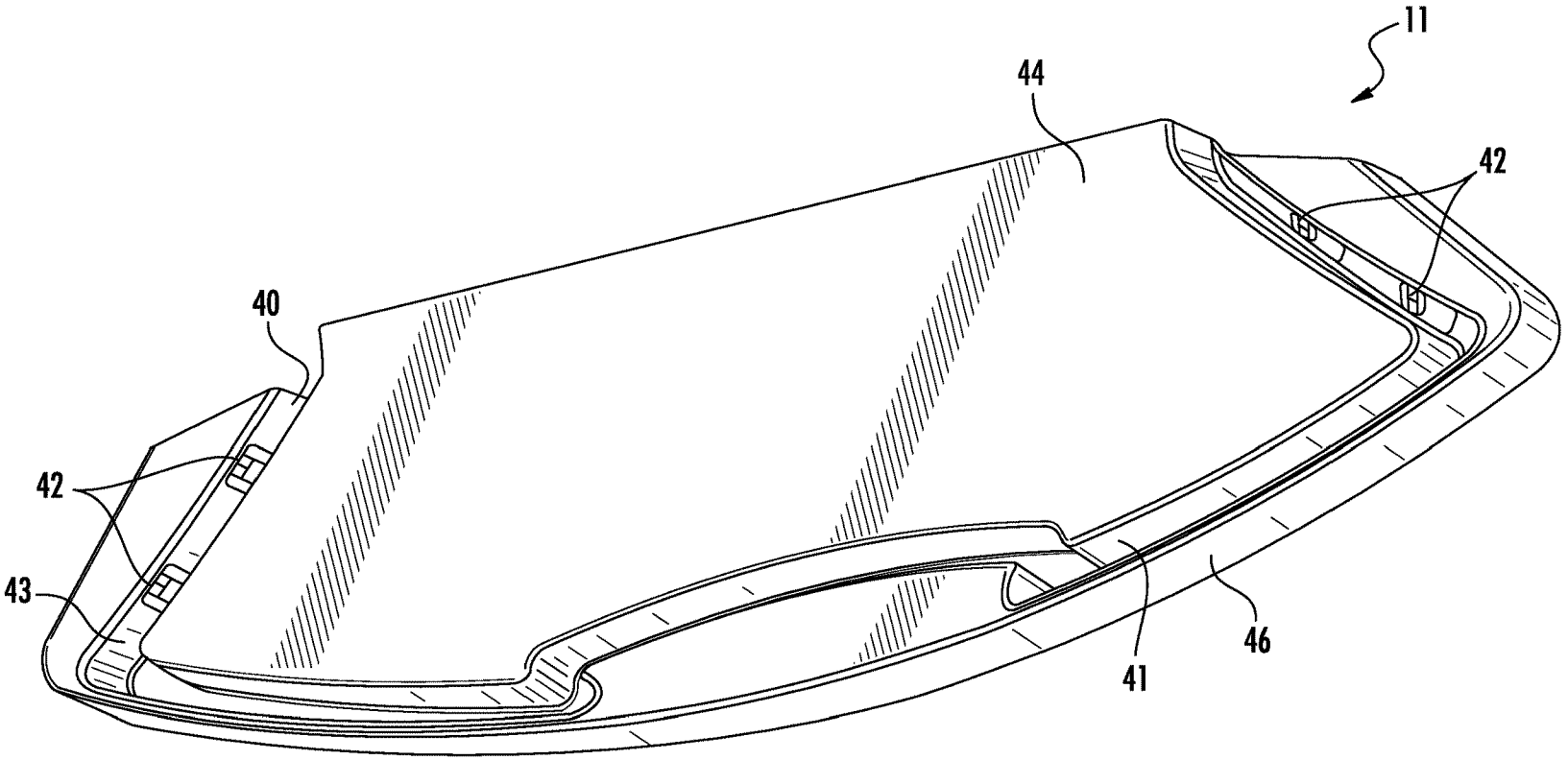

Embodiments of the present invention provide a troffer-style light fixture that is particularly well-suited for use with solid state light sources, such as LEDs. Referring to FIGS. 1A-1C the light fixture 1 comprises a troffer housing 6 that may be removably attached within a T grid, ceiling grid or other suitable support structure. The light fixture 1 is shown in FIGS. 1A and 1B in a typical orientation where the light is emitted in a generally downward direction; however, in use the light fixture may have other orientations. The light fixture 1 includes a lens assembly 2, which creates an interior space 4 (FIG. 8). The interior space 4 created by the lens assembly 2 houses LED assembly 8 and in some circumstances a light engine and/or additional electronics. Light assembly 2 comprises first end cap 10 and second end cap 11 that are disposed at either end of the lens 12 to close the interior space 4 and facilitate mounting of the lens assembly 2 in troffer housing 6. The troffer housing 6 may also support lamp electronics 21 such as a driver, power supply, control circuitry for Smart Cast technology or the like.

Figure 2:
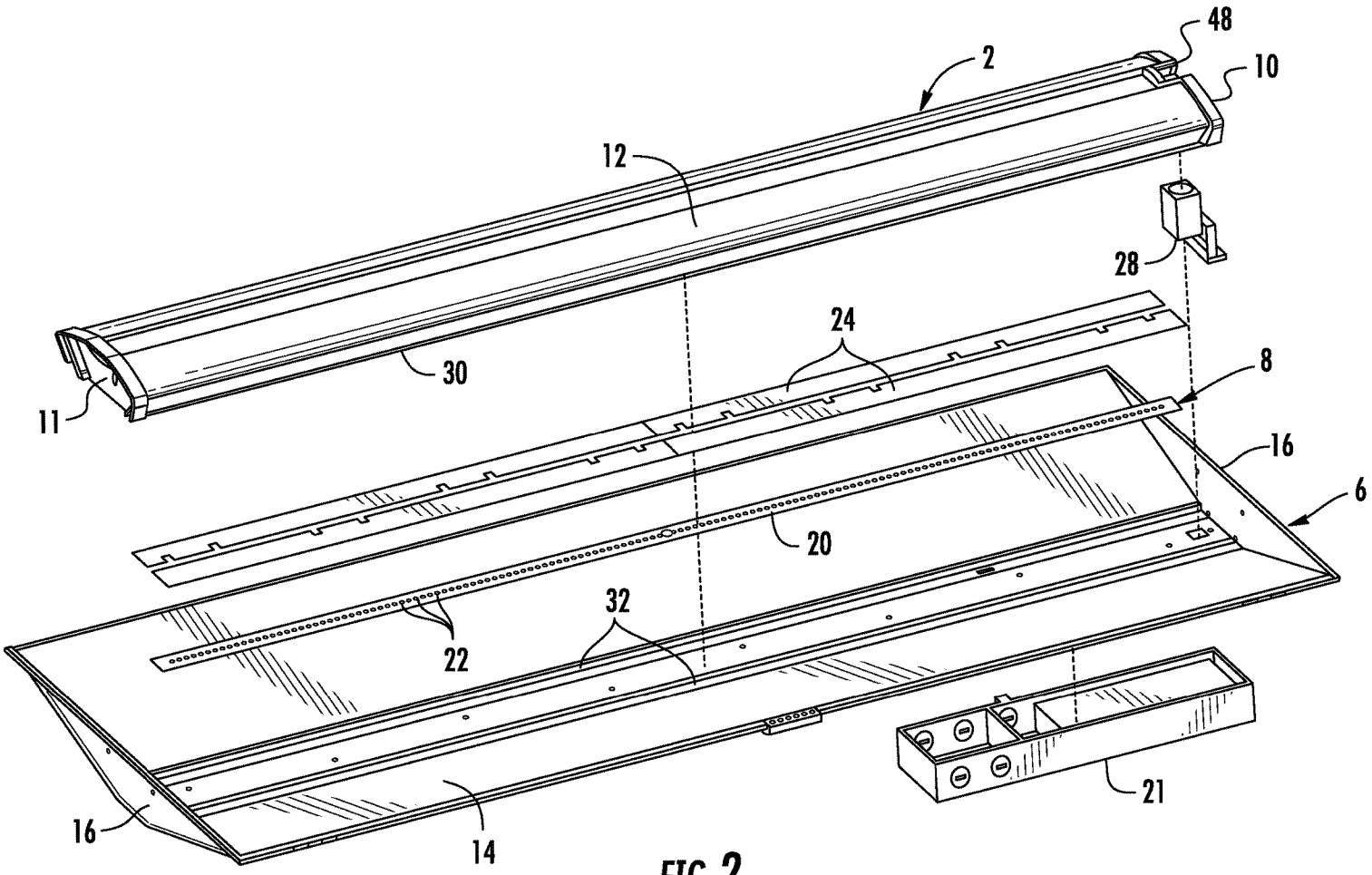
FIG. 2 is an exploded perspective view of the lighting fixture of FIG. 1.
Figure 3:
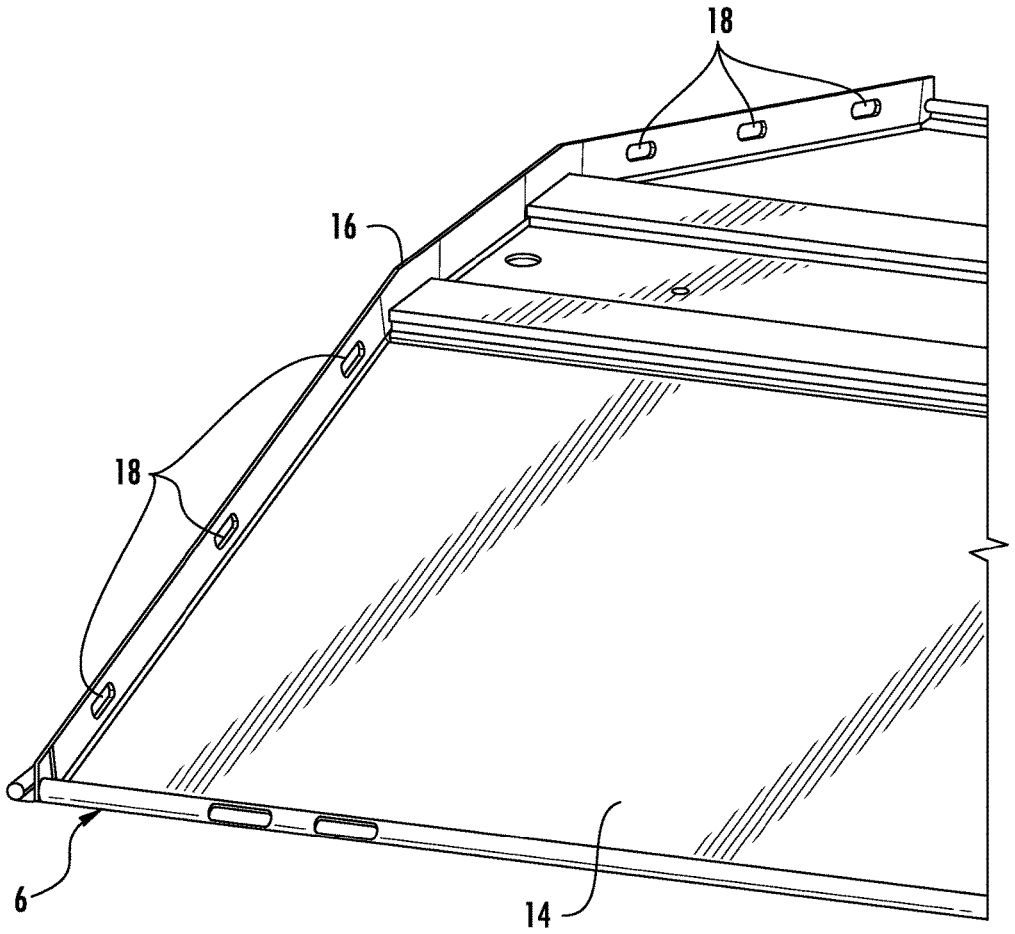
FIG. 3 is a partial perspective view of the lighting fixture of FIG. 1.

FIG. 2 is an exploded perspective view of light fixture 1 according to an embodiment of the present invention. The housing 6 comprises a back panel 14 having an end panel 16 secured to each end thereof. The end panels 16 and back panel 14 form a recessed pan style troffer housing defining an interior space for receiving the LED assembly 8 and the lens assembly 2. The end panels 16 and back panel 14 may be made of multiple sheet metal components secured together or the panels 14 and 16 and/or housing 6 may be made of a single piece of sheet metal formed into the desired shapes. In some embodiments, the back panel 14 may be multiple pieces. In one embodiment, the end panels 16 are separately secured to the back panel 14 using a clinching joint 18, as shown in FIG. 3, such as a TOX® joint. In other embodiments the connection between the end panels 16 and back panel 14 may be made by welding, screws, tabs and slots or the like. Use of a clinching joint 18 between the sheet metal panels provides a relatively low cost secure connection where the panels do not move relative to one another during use of the lamp.

The exposed surfaces of the back panel 14 and end panels 16 may be made of or coated with a reflective metal, plastic, or white material. One suitable metal material to be used for the reflective surfaces of the panels is aluminum (Al). The reflective surfaces of the panels may also include diffusing components if desired. The reflective surfaces of the panels may comprise many different materials. For many indoor lighting applications, it is desirable to present a uniform, soft light source without unpleasant glare, color striping, or hot spots. Thus, the panels may comprise a diffuse white reflector, such as a microcellular polyethylene terephthalate (MC-PET) material or a DuPont/WhiteOptics material, for example. Other white diffuse reflective materials can also be used. The reflectors may also be aluminum with a diffuse white coating.

Figure 4:
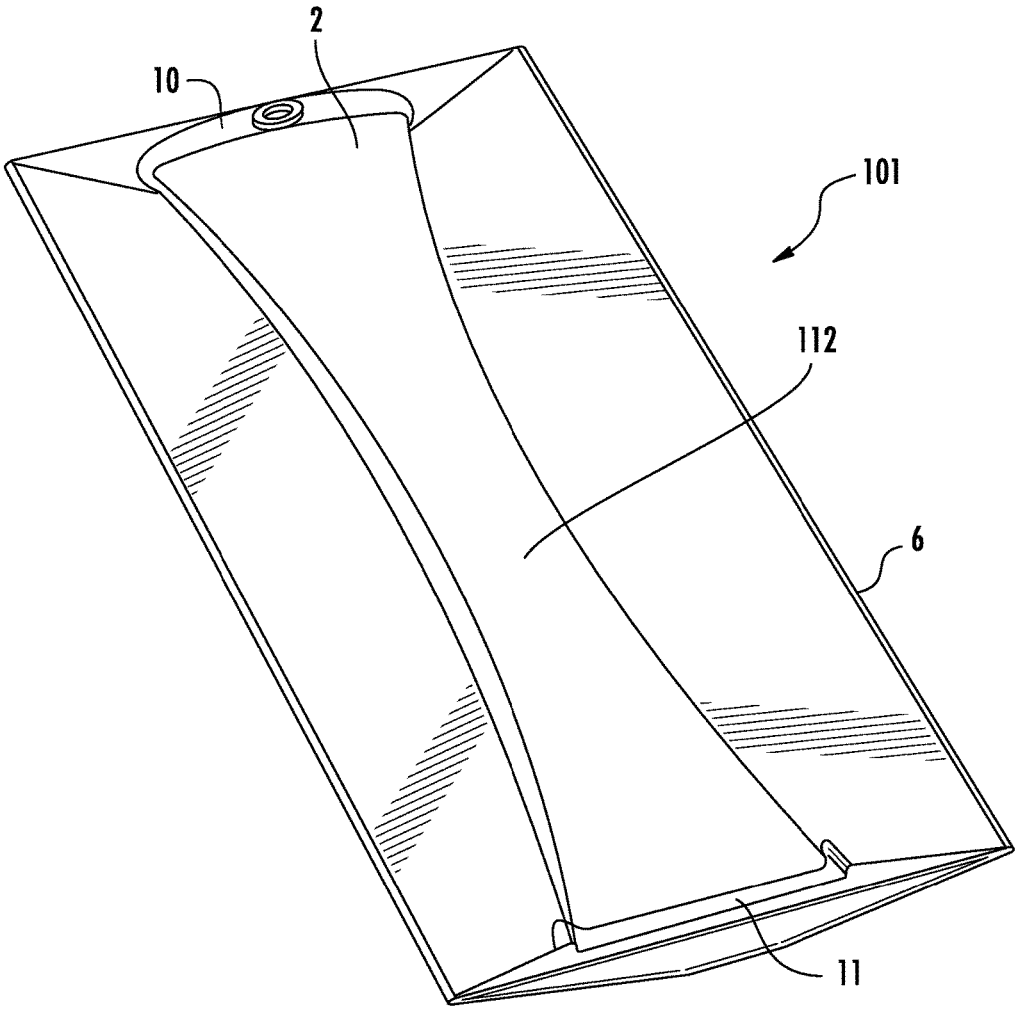
FIG. 4 is a perspective view of another embodiment of a lighting fixture.

The shape and optical properties of the lens 12 may be changed for aesthetic purposes and/or to change the emission pattern of the light emitted from the light fixture 1. For example FIG. 4 is a perspective view of a light fixture 101 according to another embodiment of the present disclosure. Light fixture 101 is similar to the light fixture 1 shown in FIG. 1, except that the lens 112 has an hourglass shape.

Many different troffer housings, reflector assemblies, LED assemblies and lens configurations may be used to achieve a particular output light profile. The light fixture may be provided in many sizes, including standard troffer fixture sizes, such as 2 feet by 4 feet (2'×4'), 1 foot by 4 feet (1'×4') or 2 feet by 2 feet (2'×2'), for example. However, it is understood that the elements of the light fixture may have different dimensions. Furthermore, it is understood that embodiments of the fixture can be customized to fit most any desired fixture dimension. The light fixture 1 may be mounted within a T grid by being placed on the supports of the T grid. In other embodiments, additional attachments, such as tethers, may be included to stabilize the fixture in case of earthquakes or other disturbances. The lighting schemes shown in the figures are meant to be exemplary. Thus, it is understood that many different dimensions of light emitter, lens, and reflector combinations can be used to generate a desired output and light color.

In this particular embodiment, a driver circuit is housed within a compartment 21. Electronic components within the compartments may be shielded and isolated. Various driver circuits may be used to power the light sources. Suitable circuits are compact enough to fit within the compartments, while still providing the power delivery and control capabilities necessary to drive high-voltage LEDs, for example. At the most basic level a driver circuit may comprise an AC to DC converter, a DC to DC converter, or both. In one embodiment, the driver circuit comprises an AC to DC converter and a DC to DC converter, both of which are located inside the compartment. In another embodiment, the AC to DC conversion is done remotely (i.e., outside the fixture), and the DC to DC conversion is done at the control circuit inside the compartment. In yet another embodiment, only AC to DC conversion is done at the control circuit within the compartment.

The LED assembly 8 comprises a LED board 20 with light emitters. The LED board 20 may be any appropriate board, such as a PCB or flexible circuit board. Light emitters may include any appropriate light emitters, such as LEDs 22. The LED board 20 can include the electronics and interconnections necessary to power the LEDs 22. In some embodiments the LED board 20 comprises a PCB with the LEDs 22 mounted and interconnected thereon. The LED assembly 8 may include clusters of discrete LEDs, with each LED within the cluster spaced a distance from the next LED, and each cluster spaced a distance from the next cluster. Some embodiments may use a series of clusters having two blue-shifted-yellow LEDs ("BSY") and a single red LED ("R"). Once properly mixed the resultant output light will have a "warm white" appearance. Other embodiments may use a series of clusters having three BSY LEDs and a single red LED. This scheme will also yield a warm white output when sufficiently mixed. Yet other embodiments may use a series of clusters having two BSY LEDs and two red LEDs. This scheme will also yield a warm white output when sufficiently mixed. In other embodiments separate blue-shifted-yellow LEDs and a green LED and/or blue-shifted-red LEDs and a green LED may be used. Details of suitable arrangements of the LEDs and lamp electronics for use in the light fixture 1 are disclosed in U.S. patent application Ser. No. 15/226,992, entitled "Solid State Light Fixtures Suitable for High Temperature Operation Having Separate Blue-Shifted-Yellow/Green and Blue-Shifted-Red Emitters" filed on Aug. 3, 2016 which is incorporated by reference herein in its entirety. In other embodiments, all similarly colored LEDs may be used where for example all warm white LEDs or all warm white LEDs may be used where all of the LEDs emit at a similar color point. In such an embodiment all of the LEDs are intended to emit at a similar targeted wavelength; however, in practice there may be some variation in the emitted color of each of the LEDs such that the LEDs may be selected such that light emitted by the LEDs is balanced such that the lamp emits light at the desired color point. In the embodiments disclosed herein a various combinations of LEDs of similar and different colors may be selected to achieve a desired color point. The interior space 4 defined by the lens 12 and the end caps 10, 11 mixes the light emitted by the LEDs to create an even, mixed light distribution that eliminates visible color spots and hot spots.

The LED board 20 may be aligned with the center of the housing 6 and lens 12. It is understood that nearly any length of LED board can be used. In some embodiments, any length of LED board can be built by combining multiple boards together to yield the desired length. The LEDs 22 can be mounted in a linear pattern or in clusters. Referring to FIG. 2, the light fixture 1 comprises an elongated rigid support structure 24 supporting an LED assembly 8. The support structure 24 may comprise a thermally conductive material such that it functions as a heat sink to dissipate heat from the LED assembly. Moreover the support structure may be thermally coupled to the housing such that heat from the LEDs is conducted to the housing via the support structure 24. The LED board 20 provides physical support for the LEDs 22 and may form part of the electrical path to the LEDs for delivering current to the LEDs. The LED board 20 may comprise a PCB, flex circuit or the like and may be connected to the support structure by any suitable connection mechanism including adhesive, screws, snap-fit connectors, board receptacles or the like. The term "electrical path" is used to refer to the entire electrical path to the LEDs 127, including an intervening power supply and all the electronics in the lamp disposed between the electrical connection that would otherwise provide power directly to the LEDs and the LEDs. Electrical conductors run between the LEDs and the source of electrical power, such as a buildings electrical grid, to provide critical current to the LEDs 127.

The electronic circuitry for powering the LEDs 22 such as the driver and power supply and other control circuitry may be contained as part of the light emitting assembly 8 or some or all of the lamp electronics may be supported separately from the light emitting assembly such as in housing 21 as shown in FIGS. 1A, 1B, 2 and 8.

Further, any of the embodiments disclosed herein may include one or more communication components 28 forming a part of the light control circuitry, such as an RF antenna that senses RF energy. The communication components may be included, for example, to allow the luminaire to communicate with other luminaires and/or with an external wireless controller. More generally, the control circuitry includes at least one of a network component, an RF component, a control component, and a sensor. The sensor, such as a knob-shaped sensor, may provide an indication of ambient lighting levels thereto and/or occupancy within the room or illuminated area. Such a sensor may be integrated into the light control circuitry. In various embodiments described herein various smart technologies may be incorporated in the lamps as described in the following United States patent applications "Solid State Lighting Switches and Fixtures Providing Selectively Linked Dimming and Color Control and Methods of Operating," application Ser. No. 13/295,609, filed Nov. 14, 2011, which is incorporated by reference herein in its entirety; "Master/Slave Arrangement for Lighting Fixture Modules," application Ser. No. 13/782,096, filed Mar. 1, 2013, which is incorporated by reference herein in its entirety; "Lighting Fixture for Automated Grouping," application Ser. No. 13/782,022, filed Mar. 1, 2013, which is incorporated by reference herein in its entirety; "Multi-Agent Intelligent Lighting System," application Ser. No. 13/782,040, filed Mar. 1, 2013, which is incorporated by reference herein in its entirety; "Routing Table Improvements for Wireless Lighting Networks," application Ser. No. 13/782,053, filed Mar. 1, 2013, which is incorporated by reference herein in its entirety; "Commissioning Device for Multi-Node Sensor and Control Networks," application Ser. No. 13/782,068, filed Mar. 1, 2013, which is incorporated by reference herein in its entirety; "Wireless Network Initialization for Lighting Systems," application Ser. No. 13/782,078, filed Mar. 1, 2013, which is incorporated by reference herein in its entirety; "Commissioning for a Lighting Network," application Ser. No. 13/782,131, filed Mar. 1, 2013, which is incorporated by reference herein in its entirety; "Ambient Light Monitoring in a Lighting Fixture," application Ser. No. 13/838,398, filed Mar. 15, 2013, which is incorporated by reference herein in its entirety; "System, Devices and Methods for Controlling One or More Lights," application Ser. No. 14/052,336, filed Oct. 10, 2013, which is incorporated by reference herein in its entirety; and "Enhanced Network Lighting," Application No. 61/932,058, filed Jan. 27, 2014, which is incorporated by reference herein in its entirety. Additionally, any of the light fixtures described herein can include the smart lighting control technologies disclosed in U.S. Provisional Application Ser. No. 62/292,528, titled "Distributed Lighting Network", filed on Feb. 8, 2016 and assigned to the same assignee as the present application, the entirety of this application being incorporated by reference herein.

Figure 5:
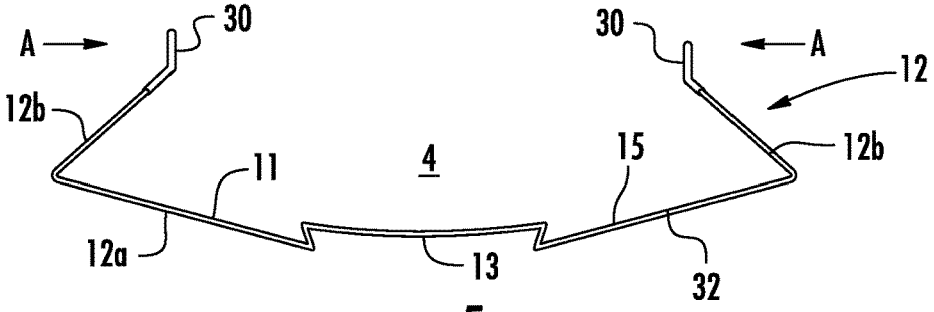
FIGS. 5, 6 and 7 are end views of alternative embodiments of a lens usable in the light fixture.
Figure 6:
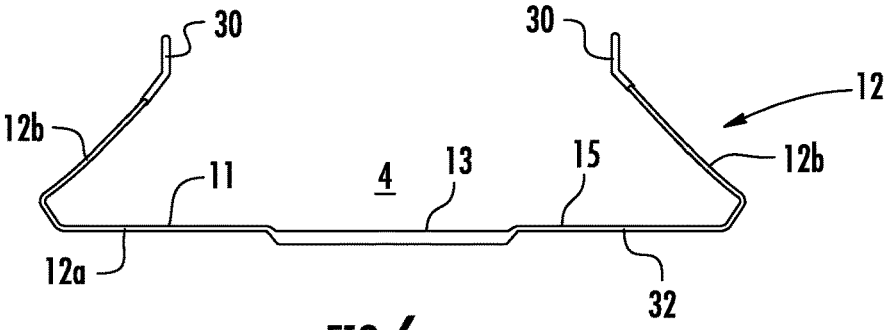
Figure 7:
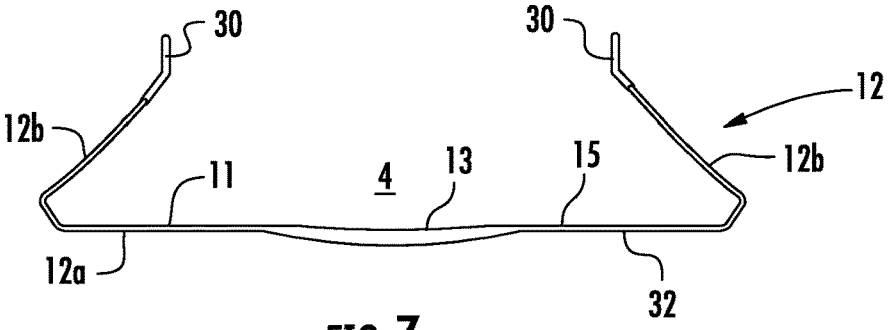

The lens 12 may be a one-piece member or it may be constructed of multiple pieces assembled to create the lens. The lens 12 may be made of plastic, such as extruded plastic. In one embodiment the entire lens 12 is light transmissive and diffusive. In other embodiments, the front portion 12*a* of the lens 102 may be clear or diffuse to allow to be emitted from the lens while the side walls of the lens 12*b* or portions of the side walls such as the surfaces adjacent to the LEDs 22 may be reflective. For example, this area may be coated with a white reflective material. The front portion 12*a* of the lens 102 may be uniform or may have different features and diffusion levels. In yet other embodiments, a portion of the lens may be more diffuse than the remainder of the lens. FIGS. 5-7 show various profiles for the lens 112. For example, the convex curved lens of FIG. 5 may provide a wider emission angle than the flat lenses of FIGS. 6 and 7. The front portion 12*a* of the lens has three distinct areas 11, 13 and 15 that extend for the length of the lens. The three longitudinal areas break the light up into three parts, a central zone emitted by area 13 and two side zones emitted by areas 11 and 15. The central zone 13 is the most obvious illuminated zone with the LEDs disposed directly behind this area. The two side zones 11, 15 offer similar light but with less glare. The channel that defines the central area has a functional purpose in that optical films with any type of pattern or diffusion can be inserted in the channel to customize the look of the fixture as well as offer functional benefits such as greater diffusion, some light bending, and customized patterns. The center recess shown in FIG. 5 also decreases the visual appearance of LED pixilation.

In one embodiment the lens 12 has a front portion 12*a* connected to two side walls 12*b* to define a generally U-shaped profile having an open top end defined by a pair of longitudinal edges 30. The longitudinal edges 30 extend for the length of the lens and extend generally parallel to the LED assembly 8 between the end caps 10, 11. The longitudinal edges 30 define opposed flared flanges that engage mating slots 32 formed in the back panel 14 of the housing 6. The opposite ends of the lens 12 define side edges 32 having a shape as shown, for example, in FIGS. 5 through 7. The side edges 32 engage end caps 10, 11 such that the end caps 10, 11 and lens 12 are removably mounted to the housing 6 as a unit. The lens 12 may be extruded of resilient material such as plastic such that the longitudinal edges 30 of the lens 12 may be compressed toward one another upon the application of a force in the direction of arrows A (FIG. 5).

Referring to FIGS. 9-12 the end caps 10 and 11 are substantially identical except that end cap 10 is slightly wider and includes an aperture 48 in order to accommodate the communication components 28 such as a sensor, RF components or the like if the light fixture is used with Smart Cast technology as previously described. In some embodiments, one of each of end caps 10 and 11 are used; however, in some embodiments to end caps 10 may be used or two end caps 11 may be used depending upon the communication components 28 used. The end caps may be provided in various dimensions and styles suitable for the aesthetics of the light fixture.

Each end cap 10, 11 comprises a wall 44 that forms the end of the enclosure defining space 4. The wall 44 terminates in one side wall 41 of slot 40 and the opposite side wall 43 of the slot 40 is formed by a flange 46 spaced from the end wall 44. The slot 40 is configured to receive one side edge 32 of the lens 12 such that one end cap 10, 11 is mounted to either end of the lens 12. The slot 40 and lens 12 have mating complex shapes such that the end cap 10 is substantially prevented from moving relative to the lens 12 in the x-y plane. The width W of the slot 40 may be greater than the thickness of the lens 12 to accommodate manufacturing tolerances in the extruded lens. To retain the lens 12 in the slot 40 retaining members may be provided. In one embodiment the retaining members comprise resilient members 42 that extend from one of the side walls 41, 43 of the slot 40 such that when the lens 12 is inserted into the slot 40 the resilient members 42 are deformed into engagement with the lens to create a force on the lens 12 sufficient to retain the end caps 10, 11 on the lens 12. The end caps 10, 11 may be formed of plastic and the resilient members 42 may be formed as one piece with the end caps where the members extend from one side wall of the slot across the slot. Where manufacturing tolerances are tightly controlled, the lens 12 may be press fit into the mating slot 40 and the resilient members 42 may be eliminated. In other embodiments the retaining members may comprise separate clips, fasteners, tabs and slots, snap-fit connectors or the like.

Figure 11:
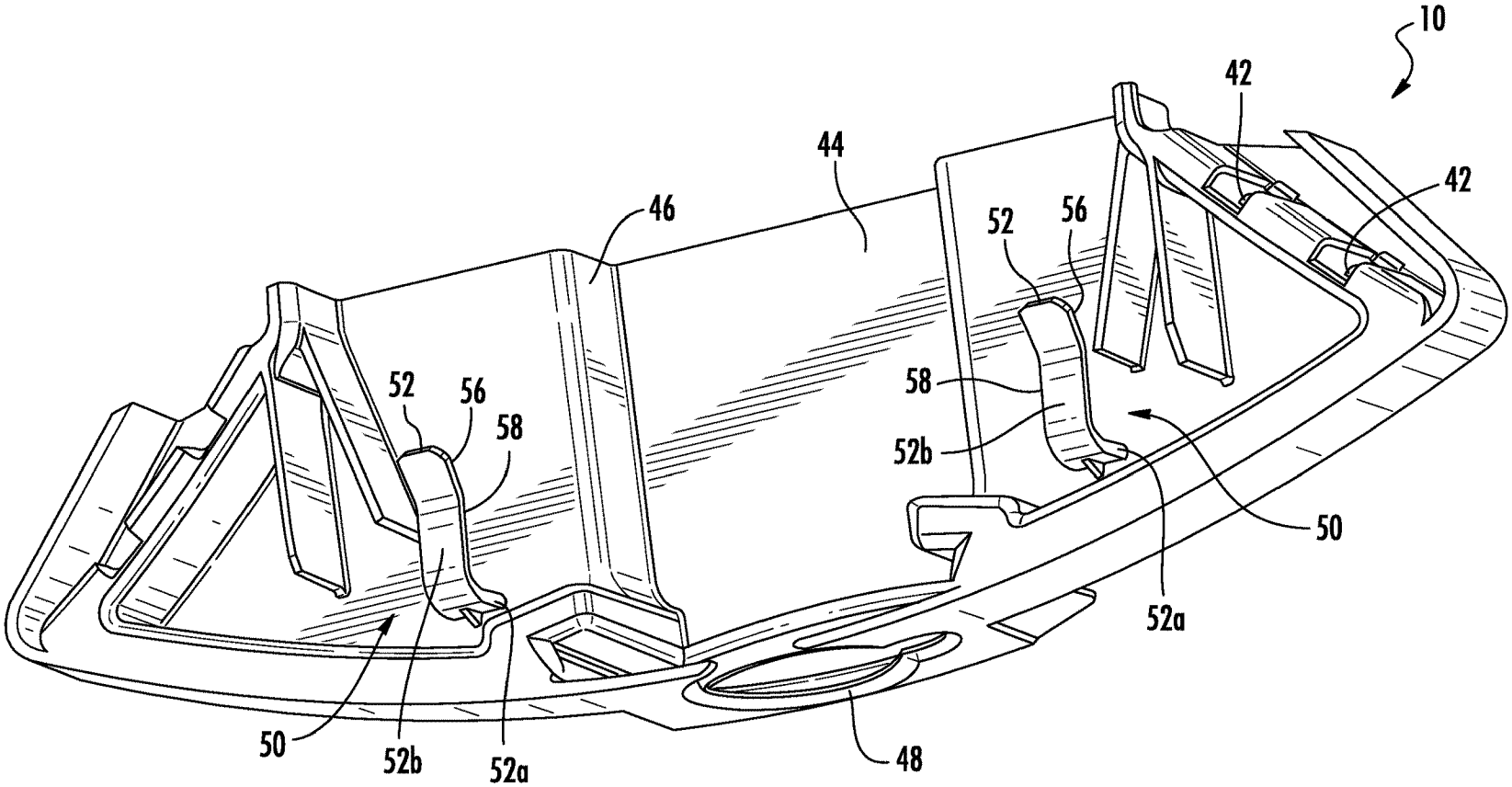
FIGS. 11 and 12 are perspective back views of the end caps of FIGS. 9 and 10, respectively.
Figure 12:
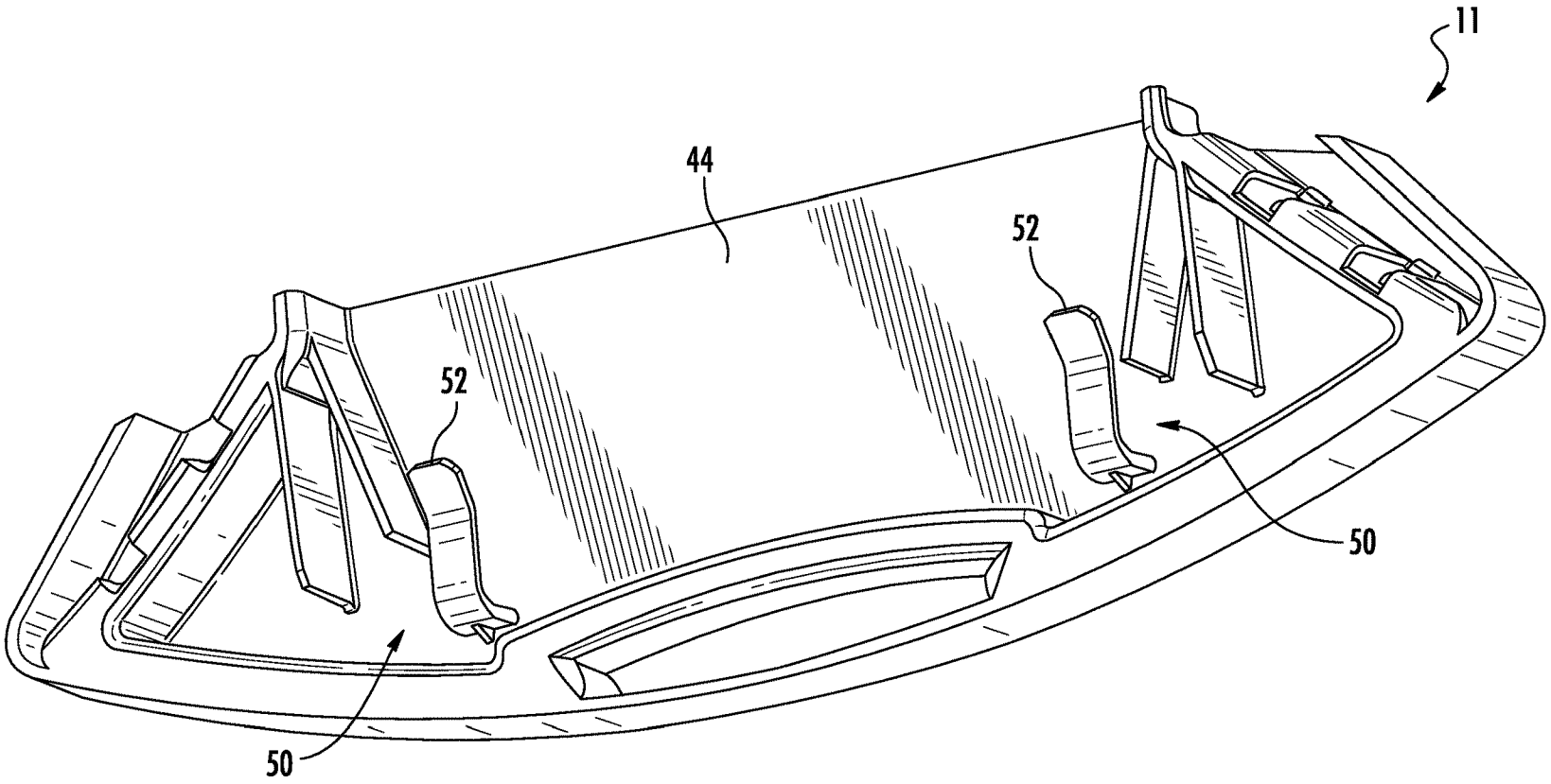
Figure 13:
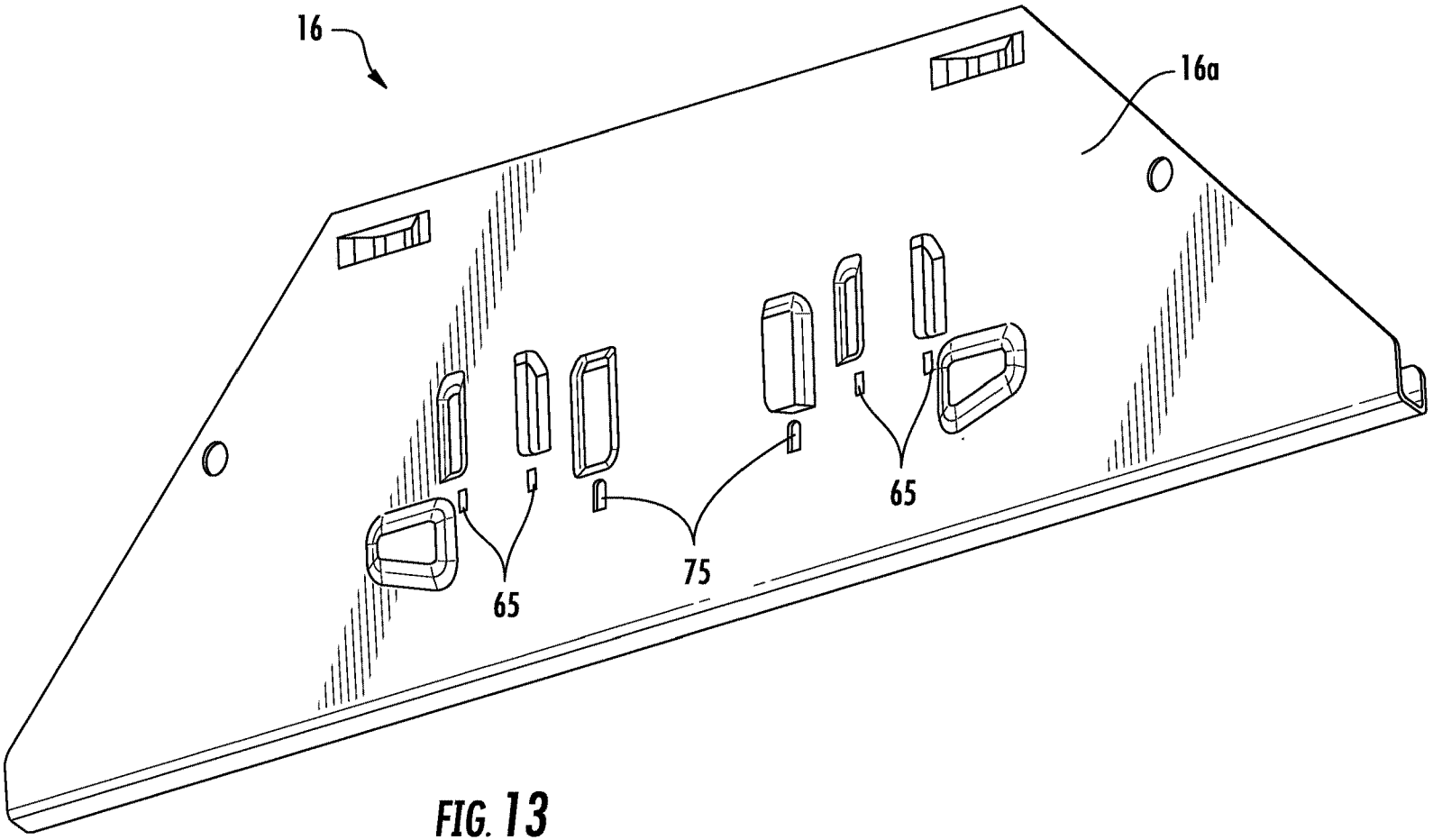
FIG. 13 is a perspective view of an end panel of the troffer housing.
Figure 14:
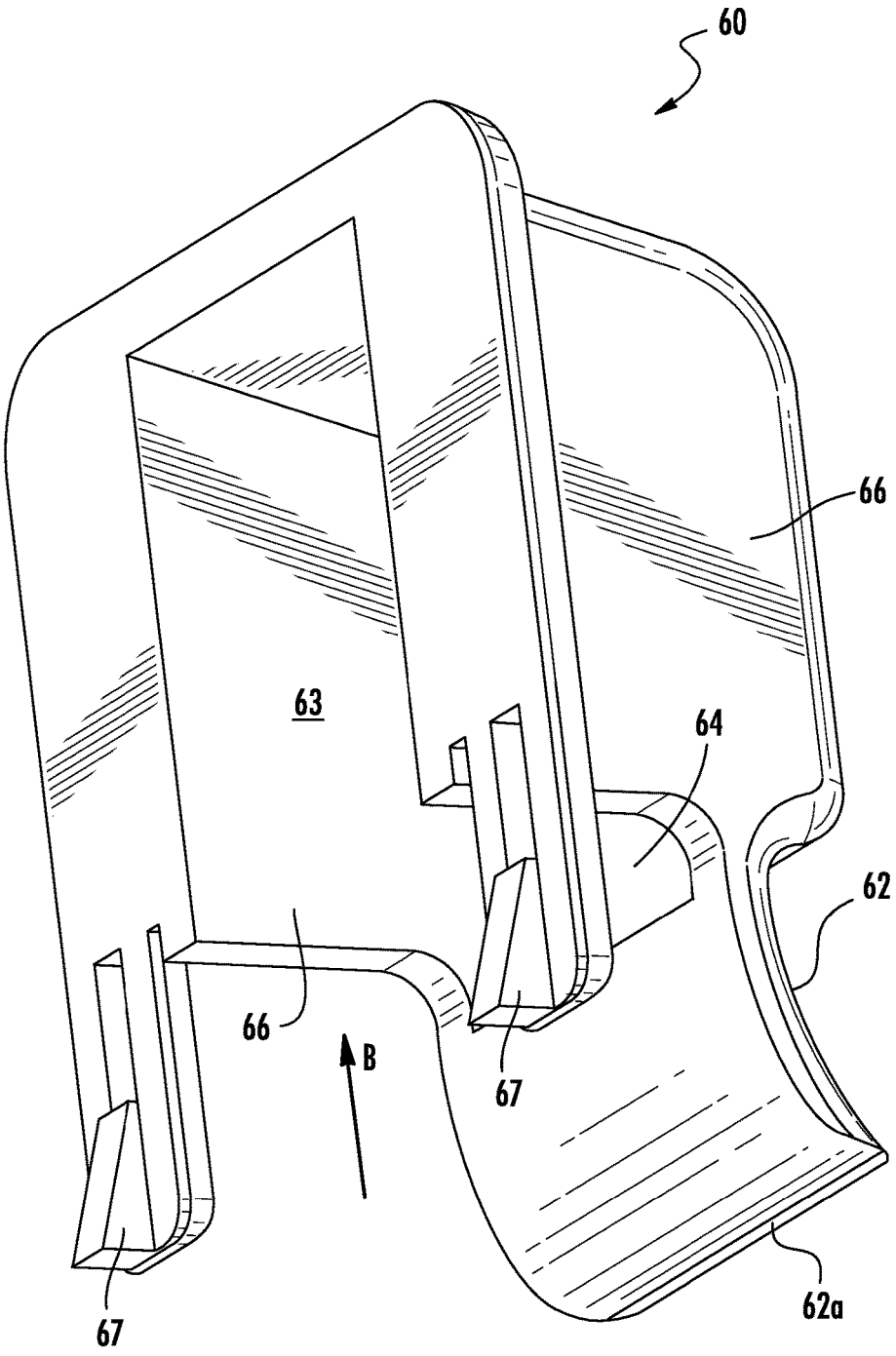
FIG. 14 is a perspective view of an engagement member that is mounted to the end panel.

Referring to FIGS. 11 and 12 the opposite side of wall 44 includes first mounting structures 50 for mounting the end caps 10 to the housing 6. Each mounting structure 50 comprises an upwardly extending deformable, resilient engagement member 52 extending from the end wall 44. The engagement member 52 has a first leg 52*a* that extends substantially perpendicularly from the wall 44 and a second leg 52*b* that extends from the first leg generally parallel to the wall 44 and terminates in a free end. The engagement members 52 may be formed as one piece with the end caps 10, 11 where the end caps and engagement members may be molded of plastic as a one-piece member. In other embodiments the engagement members 52 may be separate components from the end caps and may be secured thereto by any suitable connection mechanism. In the illustrated embodiment two engagement members 52 are provided on each end cap 10, 11 spaced laterally from one another on the wall 44 although a greater or fewer number of engagement members may be used. The second leg 52*b* includes a flared portion 56 that angles away from the wall 44 to facilitate the engagement with a mating second engagement member on the end panel 16 of housing 6. A protrusion 58 may be provided on the interior face of second leg 52*b*.

The first mounting structures 50 on the end caps 10 engage mating second mounting structures 60 formed on the exposed surfaces 16*a* of the end panels 16. Referring to FIGS. 13-18 the second mounting structures 60 comprise a relatively rigid engagement member 62 supported in a spaced relationship relative to the end panel 16. The second engagement member 62 is supported on the end panel 16 by a pair if sidewalls 66 that are joined to the opposite sides of the engagement member 62 to create a receptacle 63 for receiving the first engagement member 52. Configuring that second mounting structure 60 as a receptacle provides proper alignment between the lens assembly 12 and the troffer housing 6 during installation of the lens assembly 12. Other alignment mechanisms may also be used. The second mounting structures 60 are secured to the end panels 16 such that the receptacles 63 faces the end panel and the second engagement members 62 are spaced from the end panels 16. In one embodiment pairs of slots 65 are provided in the end panels 16 that receive tabs 67 formed on the second mounting structures 60 to position the second mounting structures 60 to receive the first mounting structures 50. The second mounting structures 60 may be secured to the end panels 16 using any suitable connection mechanism such as welding, crimping, separate fasteners or the like.

Figure 15:
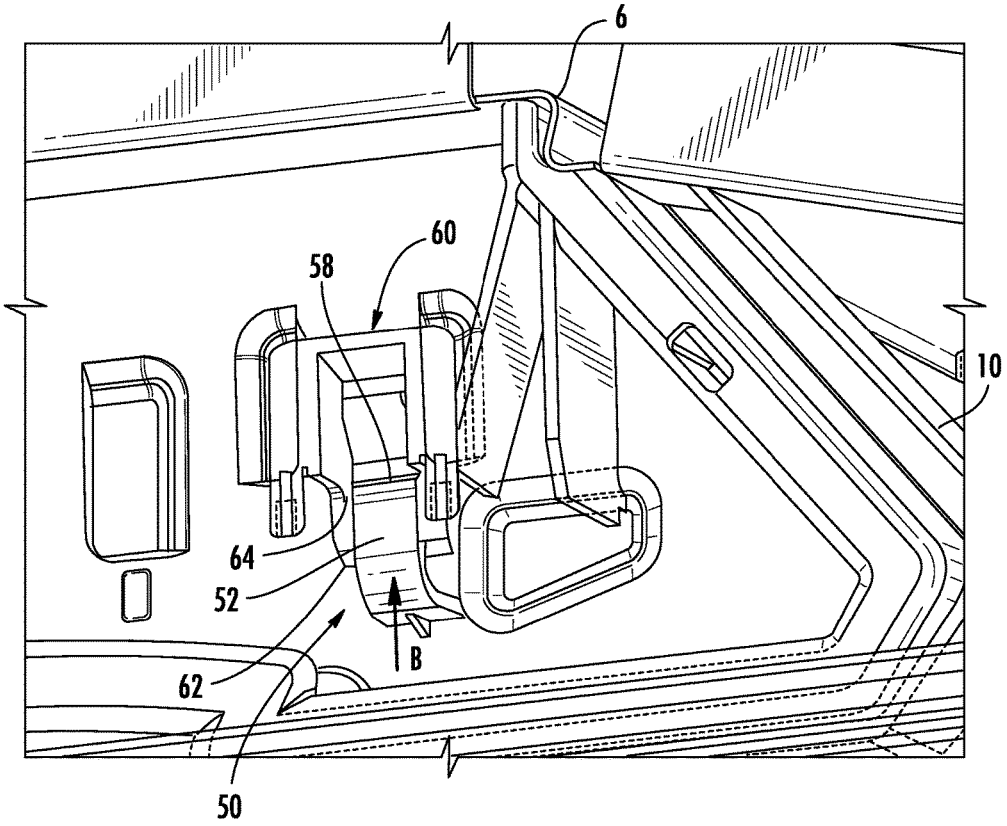
FIG. 15 is a perspective view showing the engagement of one engagement member on the troffer housing with one engagement member on the end cap.
Figure 16:
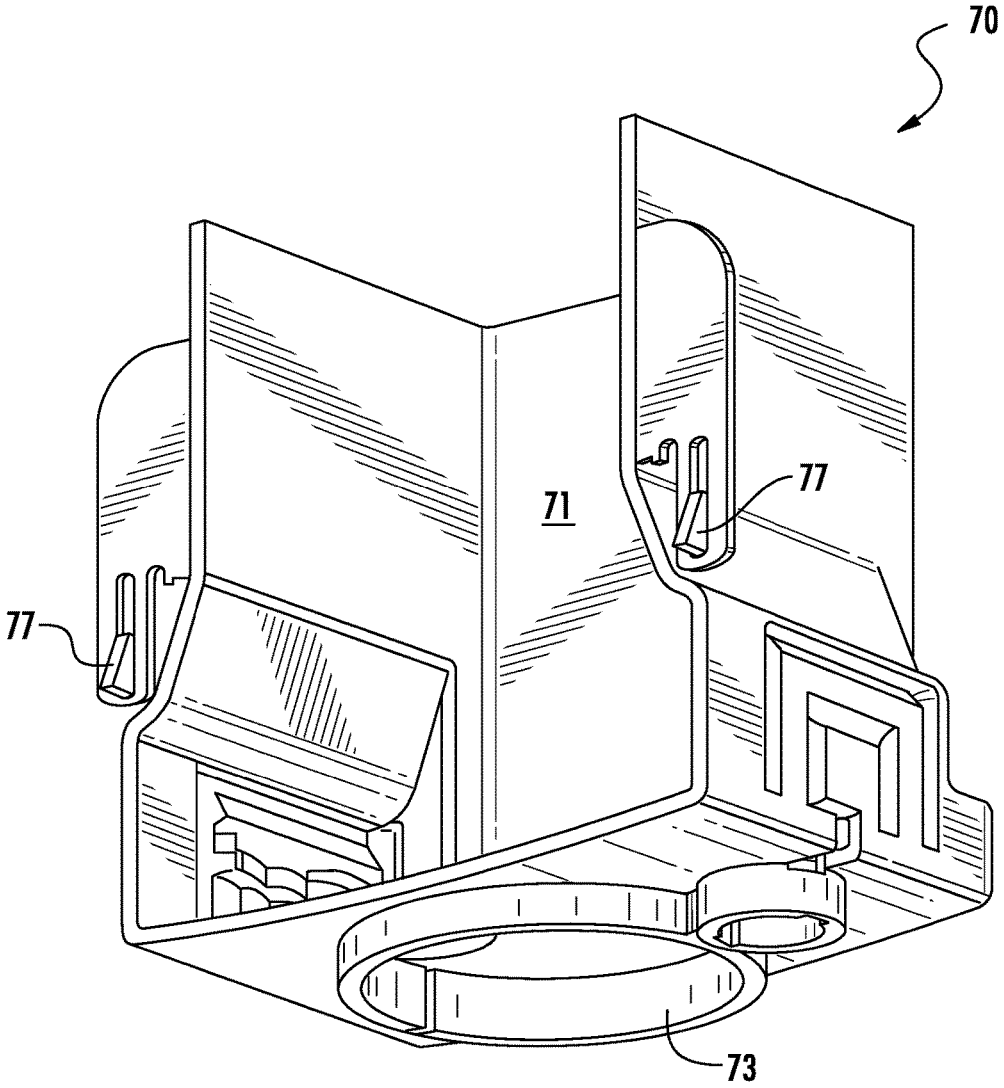
FIG. 16 is a perspective view of an electronics housing that is mounted to the end panel.
Figure 17:
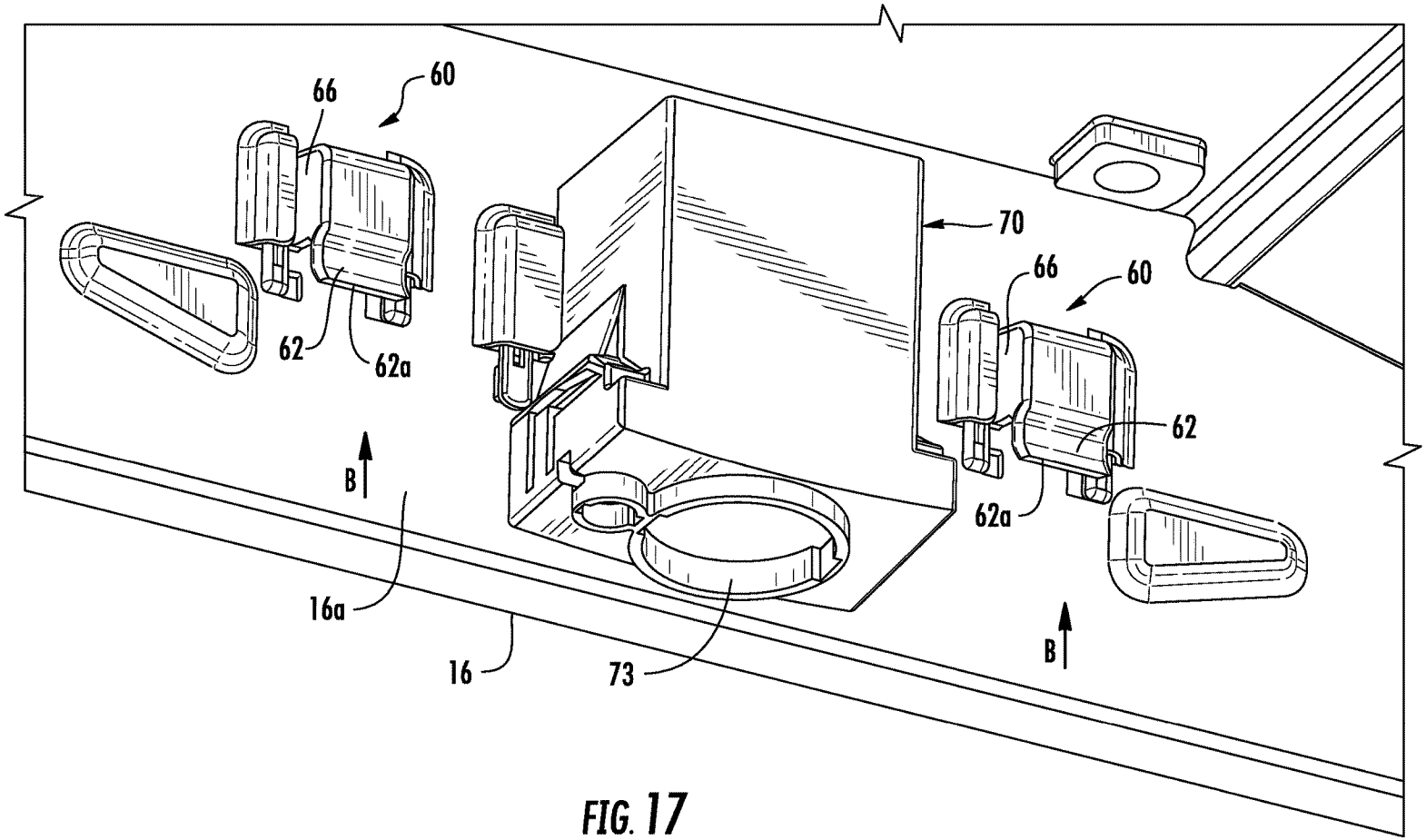
FIGS. 17 and 18 are detailed perspective views showing the engagement members and electronics housing mounted to the end panel.
Figure 18:
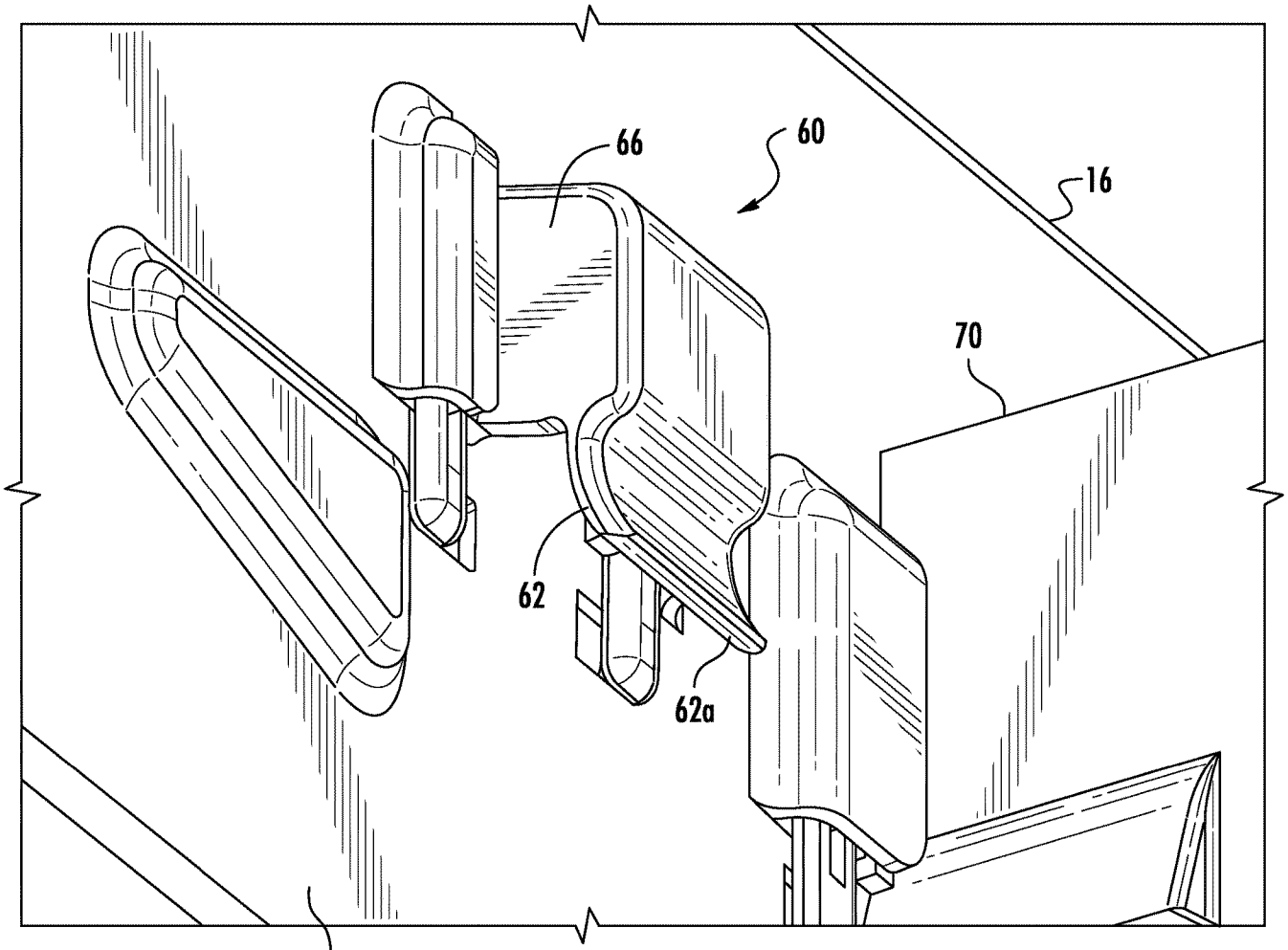

The rigid engagement member 62 has a flared free end 62*a* and is angled general toward panel 16 from its free end 62*a* and is configured to be engaged by the first engagement member 52 when the lens assembly 12 is mounted in the troffer housing 6. The engagement member 62 is disposed at an angle relative to the insertion direction B such that when the first engagement member 52 contacts the engagement member 62 it is deformed by the engagement member 62 as the lens assembly is moved linearly in the insertion direction B. Specifically the first engagement member 52 is flexed toward the surface 16*a* of end panel 16 to create a holding force between the first engagement member 52 and the second engagement member 62. The rigid engagement member 62 defines a lip or ledge 64 where, as the protrusion 58 on the resilient member 52 member passes the lip 64, the first engagement member 50 moves resiliently toward the undeformed state (away from the surface 16*a* of end panel 16) such that the protrusion 58 on the resilient engagement member 52 engages the lip or ledge 64 on the second engagement member 62. The engagement member 52 is resiliently deformed in this position such that it continues to exert a holding force on the engagement member 62 as shown in FIG. 15. The holding force is created by the friction force between the first engagement member 52 and the second engagement member 62 as well as by the mechanical engagement between the protrusion 58 on the first engagement member and the lip 64 on the second engagement member. Both forces are generated by the resilient deformation of the first engagement member into engagement with the second engagement member. While in the illustrated embodiment the first engagement member 52 on the end caps 10 is resilient and the second engagement member 62 on the troffer housing 6 is substantially rigid, the members may be reversed such that the first engagement member on the end caps 10 is rigid and the second engagement member on the troffer housing 6 is resilient and deformable. Moreover, both the first and second engagement members may be resiliently deformable.

The force created between the first and second engagement members is sufficient to hold the lens assembly 2 in the housing 6; however, the holding force is low enough that a user may remove the lens assembly 2 from the housing 6 by pulling the lens assembly downwardly in a direction opposite to the insertion direction B. Thus, the lens assembly 2 including the lens 12 and end caps 10 may be mounted in the housing by moving the lens assembly 2 linearly in a first insertion direction relative to the housing and engaging the first engagement members 52 with the second engagement members 62 and the lens assembly 2 may be easily removed from the housing 6 by moving the lens assembly in a second linear direction opposite to the insertion direction and disengaging the first engagement members from the second engagement members. To install and remove the lens assembly the lens assembly is only moved in a simple linear movement toward and away from the housing thereby simplifying the simultaneous installation and/or removal of the lens and end caps as a unit in a single operation.

During installation of the lens assembly 2 in the troffer housing 6, as the first engagement members 52 are engaged with the second engagement members 62, the longitudinal edges 30 of the lens are inserted into the slots or recesses 32 in the troffer housing 6 such that two longitudinal edges 30 of the lens 12 are positioned inside of the longitudinal edges 34 of the slots or recesses 32 along substantially the entire lengths thereof. The side walls of the lens 12 are slightly deformed inwardly as the lens is inserted in the housing to create a seal between the side walls of the lens and the longitudinal edges 34. The lens 12 is made of a resilient plastic material such that when the compressive force is released the sidewalls of the lens will tend to move away from one another to create the seal. The seal provides a clean line between the edges 34 of the housing and the lens 12 that is not affected by variations in the planarity of the lens resulting from manufacturing tolerances. The seal inhibits bugs or debris from entering the lens. The longitudinal edges 34 may be formed as rounded camming surfaces that deform the side walls 12*a* of the lens as the lens assembly 2 is mounted in housing 6 and/or the side walls of the lens may be compressed by the user as the lens assembly is installed in the housing 6 or both. As shown in FIG. 8 the edges 30 may be flared outwardly, away from one another, and the slots 34 are also flared outwardly such that the engagement of the edges 30 with slots 34 assists in retaining the lens assembly 2 in the housing 6. Flaring the edges 30 and slots 34 create a force that resists the force of gravity on the lens assembly.

For lamps provided with Smart Cast technology at least one of the end panels 16 may be provided with a communication component housing 70 for receiving the Smart Cast components such as sensors, RF devices or other electronics. The communication component housing 70 including an aperture 73 that allows the components in the housing access to the exterior of the housing. The communication component housing 70 is secured to the end panel 16 such that a space 71 is created between the surface 16*a* of end panel 16 and the communication component housing 70. In one embodiment pairs of slots 75 are provided in the end panel 16 that receive tabs 77 formed on the communication component housing 70 to position the communication component housing 70 relative to aperture 48 in end cap 10. The tabs 77 and slots 75 are configured in one embodiment such that a snap-fit connection is created between the housing and the end panel 16. In other embodiments the communication component housing 70 may be secured to the end panels 16 using any suitable connection mechanism such as welding, crimping, separate fasteners or the like; however, using a snap-fit connection allows the communication component housing 70 to be snap-fit to the end panel and the lens assembly to be snap-fit into the housing to facilitate assembly of the lamp. The end cap 10 that is positioned adjacent the communication component housing 70 includes a recessed area 46 (FIG. 11) for receiving the communication component housing 70 such that the aperture 48 in the end cap 10 is in communication with the aperture 73 of the communication housing 70 such that the electronics contained in the communication component housing 70 may be positioned adjacent and the aperture 48 and be communication the exterior of the lamp.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A troffer light fixture, comprising:

a LED assembly comprising at least one LED operable to emit light when energized through an electrical path;

a housing; and a lens assembly comprising a lens covering the at least one LED and a first end cap and a second end cap, the lens having a first end connected to the first end cap and a second end connected to the second end cap, wherein the first end cap comprises a first wall that that closes the first end of the lens, the first wall comprising a first side and a second side opposite the first side, and a first slot formed in the first side of the first wall for receiving the first end, and the second end cap comprises a second wall that closes the second end of the lens, the second wall comprising a third side and a fourth side opposite the third side, and a second slot formed in the third side of the second wall for receiving the second end, and wherein the second side of the first wall and the third side of the second wall comprise a first one of a resilient first engagement member and second engagement member and the housing comprises a second one of the resilient first engagement member and the second engagement member where the resilient first engagement member engages the second engagement member such that the resilient first engagement member is deformed into engagement with the second engagement member such that the first end cap and the second end cap are releasably connected to the housing such that the lens and the first end cap and the second end cap are releasably mounted to the housing as a unit.

2. The light fixture of claim 1, wherein the LED assembly comprises a LED board supporting a plurality of LEDs, the LED board being in the electrical path.

3. The light fixture of claim 1, wherein the lens is resiliently deformable.

4. The light fixture of claim 1, wherein the lens is made of diffusive plastic.

5. The light fixture of claim 1, wherein the lens comprises a first longitudinal edge and a second longitudinal edge where the first and second longitudinal edges of the lens are compressed toward one another.

6. The light fixture of claim 5, wherein the housing comprises a first slot for receiving the first longitudinal edge and a second slot for receiving the second longitudinal edge where the first longitudinal edge is biased against the first slot and the second longitudinal edge is biased against the second slot.

7. The light fixture of claim 1, further comprising first retaining members for retaining the first end in the first slot and second retaining members for retaining the second end in the second slot.

8. The light fixture of claim 7, wherein the first and second retaining members comprise resilient members are deformed into engagement with the lens to create a force on the lens sufficient to retain the first end cap and the second end cap on the lens.

9. The light fixture of claim 1, wherein the second engagement member comprises a rigid member.

10. The light fixture of claim 1, wherein the second engagement member comprises a receptacle for receiving the first engagement member.

11. The light fixture of claim 1, wherein the resilient first engagement member engages the second engagement member by moving the lens assembly in a first insertion direction relative to the housing.

12. The light fixture of claim 11, wherein the resilient first engagement member is disengaged from the second engagement member by moving the lens assembly in a second direction opposite to the first insertion direction.

13. The light fixture of claim 12, wherein the first insertion direction and the second direction are substantially linear.

14. The light fixture of claim 1, wherein a force is created between the resilient first engagement member and the second engagement member, the force being sufficient to hold the lens assembly in the housing and low enough that the lens assembly is removable from the housing by pulling the lens assembly in the second direction.

15. A light fixture, comprising:

a LED assembly comprising at least one LED operable to emit light when energized through an electrical path;

a housing;

a lens assembly comprising a lens covering the at least one LED and a first end cap and a second end cap, the first end cap comprising a first aperture communicating with an exterior of the lens assembly; and a communication component housing snap-fit to the housing, the communication component housing comprising a second aperture, the second aperture being in communication with the first aperture;

at least one communication component in the communication component housing comprising at least one of a RF component and a sensor, the communication component communicating with the exterior of the lamp through the first aperture and the second aperture, the communication component controlling an operation of the lamp; wherein the first end cap and the second end cap are releasably mounted to the housing by a deformable, resilient first engagement member on one of the housing and the first end cap and second end cap that releasably engages a second engagement member on the other one of the housing and the first end cap and the second end cap.

16. The light fixture of claim 15, wherein a force is created between the first engagement member and the second engagement member, the force being sufficient to hold the lens assembly in the housing and low enough that the lens assembly is removable from the housing by pulling the lens assembly in a second direction opposite to the first insertion direction.

17. The light fixture of claim 15, wherein the lens comprises a first longitudinal edge and a second longitudinal edge where the first and second longitudinal edges of the lens are compressed toward one another and the housing comprises a first slot for receiving the first longitudinal edge and a second slot for receiving the second longitudinal edge where the first longitudinal edge is biased against the first slot and the second longitudinal edge is biased against the second slot.

18. A troffer light fixture, comprising:

a LED assembly comprising at least one LED operable to emit light when energized through an electrical path;

a housing; and a lens assembly comprising a lens covering the at least one LED and a first end cap and a second end cap, the lens having a first end connected to the first end cap and a second end connected to the second end cap, wherein the first end cap and the second end cap comprise a first one of a resilient first engagement member and second engagement member and the housing comprises a second one of the resilient first engagement member and the second engagement member where the resilient first engagement member engages the second engagement member such that the resilient first engagement member is deformed into engagement with the second engagement member such that the first end cap and the second end cap are releasably connected to the housing such that the lens and the first end cap and the second end cap are releasably mounted to the housing as a unit.

19. The light fixture of claim 1 wherein the lens comprises a first longitudinal edge and a second longitudinal edge and a recessed channel that extends substantially parallel to the first longitudinal edge and the second longitudinal edge, the recessed chanel comprising an optical film.

* * * * *